US008094784B2

(12) United States Patent
Morton

(10) Patent No.: US 8,094,784 B2
(45) Date of Patent: Jan. 10, 2012

(54) X-RAY SOURCES

(75) Inventor: Edward James Morton, Guildford (GB)

(73) Assignee: Rapiscan Systems, Inc., Hawthorne, CA (US)

( * ) Notice: Subject to any disclaimer, the term of this patent is extended or adjusted under 35 U.S.C. 154(b) by 110 days.

(21) Appl. No.: 12/478,757

(22) Filed: Jun. 4, 2009

(65) Prior Publication Data

US 2010/0008471 A1 Jan. 14, 2010

Related U.S. Application Data

(63) Continuation-in-part of application No. 12/364,067, filed on Feb. 2, 2009, which is a continuation of application No. 12/033,035, filed on Feb. 19, 2008, now Pat. No. 7,505,563, which is a continuation of application No. 10/554,569, filed as application No. PCT/GB2004/001732 on Apr. 23, 2004, now Pat. No. 7,349,525.

(30) Foreign Application Priority Data

Apr. 25, 2003 (GB) ..... 0309374.7

(51) Int. Cl.
*H01J 35/08* (2006.01)

(52) U.S. Cl. ..... 378/124; 378/143

(58) Field of Classification Search ..... 378/143, 378/124, 141, 130

See application file for complete search history.

(56) References Cited

U.S. PATENT DOCUMENTS

| | | | |
|---|---|---|---|
| 2,952,790 | A | 9/1960 | Steen |
| 3,239,706 | A | 3/1966 | Farrell et al. |
| 3,768,645 | A | 10/1973 | Conway et al. |
| 4,045,672 | A | 8/1977 | Watanabe |
| 4,057,725 | A | 11/1977 | Wagner |
| 4,105,922 | A | 8/1978 | Lambert et al. |
| 4,228,353 | A | 10/1980 | Johnson |
| 4,259,721 | A | 3/1981 | Kuznia |
| 4,266,425 | A | 5/1981 | Allport |
| 4,274,005 | A | 6/1981 | Yamamura et al. |
| 4,340,816 | A | 7/1982 | Schott |
| 4,352,021 | A | 9/1982 | Boyd et al. |
| 4,468,802 | A | 8/1984 | Friedel |

(Continued)

FOREIGN PATENT DOCUMENTS

| | | |
|---|---|---|
| EP | 0 432 568 | 6/1991 |

(Continued)

OTHER PUBLICATIONS

PCT Search Report, dated Mar. 3, 2005, Morton, Edward James et al. Search Report PCT/GB2004/001741.

(Continued)

*Primary Examiner* — Hoon Song
(74) *Attorney, Agent, or Firm* — Novel IP

(57) ABSTRACT

The present invention is directed to an anode for an X-ray tube. The X-ray tube has an electron aperture through which electrons emitted from an electron source travel subject to substantially no electrical field and a target in a non-parallel relationship to the electron aperture and arranged to produce X-rays when electrons are incident upon a first side of the target, wherein the target further comprises a cooling channel located on a second side of the target. The cooling channel comprises a conduit having coolant contained therein. The coolant is at least one of water, oil, or refrigerant.

20 Claims, 7 Drawing Sheets

U.S. PATENT DOCUMENTS

| | | | | |
|---|---|---|---|---|
| 4,672,649 | A | 6/1987 | Rutt | |
| 4,675,890 | A | 6/1987 | Plessis et al. | |
| RE32,961 | E | 6/1989 | Wagner | |
| 4,866,745 | A | 9/1989 | Akai | |
| 4,868,856 | A | 9/1989 | Frith et al. | |
| 4,887,604 | A | 12/1989 | Shefer et al. | |
| 4,894,775 | A | 1/1990 | Kritchman et al. | |
| 5,033,106 | A | 7/1991 | Kita | |
| 5,068,882 | A | 11/1991 | Eberhard | |
| 5,073,910 | A | 12/1991 | Eberhard et al. | |
| 5,191,600 | A | 3/1993 | Vincent et al. | |
| 5,195,112 | A | 3/1993 | Vincent et al. | |
| 5,247,556 | A | 9/1993 | Eckert et al. | |
| 5,259,014 | A | 11/1993 | Brettschneider | |
| 5,272,627 | A | 12/1993 | Maschhoff et al. | |
| 5,313,511 | A | 5/1994 | Annis et al. | |
| 5,367,552 | A | 11/1994 | Peschmann | |
| 5,375,156 | A | 12/1994 | Kuo-Petravic et al. | |
| 5,414,622 | A | 5/1995 | Walters | |
| 5,467,377 | A | 11/1995 | Dawson | |
| 5,511,104 | A | 4/1996 | Mueller et al. | |
| 5,568,829 | A | 10/1996 | Crawford et al. | |
| 5,604,778 | A | 2/1997 | Polacin et al. | |
| 5,633,907 | A | 5/1997 | Gravelle et al. | |
| 5,654,995 | A | 8/1997 | Flohr | |
| 5,680,432 | A | 10/1997 | Voss | |
| 5,689,541 | A | 11/1997 | Schardt | |
| 5,712,889 | A | 1/1998 | Lanzara et al. | |
| 5,841,831 | A | 11/1998 | Hell et al. | |
| 5,859,891 | A | 1/1999 | Hibbard | |
| 5,889,833 | A | 3/1999 | Silver | |
| 5,907,593 | A | 5/1999 | Hsieh et al. | |
| 5,966,422 | A | 10/1999 | Dafni et al. | |
| 5,974,111 | A | 10/1999 | Krug et al. | |
| 5,987,097 | A | 11/1999 | Salasoo | |
| 6,014,419 | A | 1/2000 | Hu | |
| 6,018,562 | A | 1/2000 | Willson | |
| 6,075,836 | A | 6/2000 | Ning | |
| 6,108,575 | A | 8/2000 | Besson | |
| 6,122,343 | A | 9/2000 | Pidcock | |
| 6,181,765 | B1 | 1/2001 | Sribar et al. | |
| 6,183,139 | B1 | 2/2001 | Solomon et al. | |
| 6,218,943 | B1 | 4/2001 | Ellenbogen | |
| 6,236,709 | B1 | 5/2001 | Perry et al. | |
| 6,269,142 | B1 | 7/2001 | Smith | |
| 6,298,110 | B1 | 10/2001 | Ning | |
| 6,324,249 | B1 | 11/2001 | Fazzio | |
| 6,341,154 | B1 | 1/2002 | Besson | |
| 6,449,331 | B1 | 9/2002 | Nutt et al. | |
| 6,470,065 | B1 | 10/2002 | Lauther | |
| 6,546,072 | B1 | 4/2003 | Chalmers | |
| 6,553,096 | B1 * | 4/2003 | Zhou et al. | 378/122 |
| 6,624,425 | B2 | 9/2003 | Nisius et al. | |
| 6,735,271 | B1 | 5/2004 | Rand et al. | |
| 6,785,359 | B2 | 8/2004 | Lemaitre | |
| 7,192,031 | B2 | 3/2007 | Dunham et al. | |
| 7,197,116 | B2 | 3/2007 | Dunham et al. | |
| 7,203,269 | B2 | 4/2007 | Huber et al. | |
| 7,218,700 | B2 | 5/2007 | Huber et al. | |
| 2001/0022346 | A1 | 9/2001 | Katagami et al. | |
| 2002/0031202 | A1 | 3/2002 | Callerame et al. | |
| 2002/0082492 | A1 | 6/2002 | Grzeszczuk | |
| 2002/0094064 | A1 | 7/2002 | Zhou et al. | |
| 2002/0978360 | | 7/2002 | Grodzins | |
| 2002/0176531 | A1 | 11/2002 | McClelland et al. | |
| 2003/0031352 | A1 | 2/2003 | Nelson et al. | |
| 2003/0048868 | A1 | 3/2003 | Bailey et al. | |
| 2003/0076921 | A1 | 4/2003 | Mihara et al. | |
| 2003/0076924 | A1 | 4/2003 | Mario et al. | |
| 2004/0120454 | A1 | 6/2004 | Ellenbogen et al. | |
| 2004/0252807 | A1 | 12/2004 | Skatter et al. | |
| 2004/0258305 | A1 | 12/2004 | Burnham et al. | |
| 2005/0031075 | A1 | 2/2005 | Hopkins et al. | |
| 2005/0053189 | A1 | 3/2005 | Makoto et al. | |
| 2005/0100135 | A1 | 5/2005 | Lowman | |
| 2005/0105682 | A1 | 5/2005 | Heumann et al. | |
| 2005/0111610 | A1 | 5/2005 | De Man et al. | |
| 2005/0157925 | A1 | 7/2005 | Lorenz | |

FOREIGN PATENT DOCUMENTS

| | | |
|---|---|---|
| EP | 0 531 993 | 3/1993 |
| EP | 0 584 871 | 3/1994 |
| EP | 0 924 742 | 6/1999 |
| EP | 0 930 046 | 7/1999 |
| EP | 1 277 439 | 1/2003 |
| EP | 1558142 | 8/2005 |
| GB | 1497396 | 1/1978 |
| GB | 1526041 | 9/1978 |
| GB | 2 015 245 | 9/1979 |
| GB | 2089109 | 6/1982 |
| GB | 2 212 903 | 8/1989 |
| JP | 570175247 | 10/1982 |
| JP | 590016254 | 1/1984 |
| JP | 59075549 | 4/1984 |
| JP | 60 0015546 | 1/1985 |
| JP | 60 0021440 | 2/1985 |
| JP | 04 079128 | 3/1992 |
| JP | 060038957 | 2/1994 |
| JP | 10 211196 | 8/1998 |
| JP | 10211196 | 8/1998 |
| JP | 2001 176408 | 6/2001 |
| JP | 2003126075 | 5/2003 |
| JP | 2004000605 | 1/2004 |
| JP | 2005013768 | 1/2005 |
| WO | WO 95/28715 | 10/1995 |
| WO | WO 99/60387 | 11/1999 |
| WO | WO 03/051201 | 6/2003 |
| WO | WO2004/097889 | 11/2004 |

OTHER PUBLICATIONS

PCT Search Report, dated May 27, 2005, Morton, Edward James et al. Search Report PCT/GB2004/001731.
PCT Search Report, dated Feb. 25, 2005, Morton, Edward James et al. Search Report PCT/GB2004/001732.
PCT Search Report, dated Mar. 21, 2005, Morton, Edward James et al. Search Report PCT/GB2004/001751.
PCT Search Report, dated Aug. 10, 2004, Morton, Edward James et al. Search Report PCT/GB2004/001747.
PCT Search Report, dated Aug. 10, 2004, Morton, Edward James et al. Search Report PCT/GB2004/001729.
US 5,987,079, 11/1999, Scott et al. (withdrawn)

* cited by examiner

X-RAY SOURCES

CROSS-REFERENCE

The present invention is a continuation-in-part of U.S. patent application Ser. No. 12/364,067, filed on Feb. 2, 2009, which is a continuation of U.S. patent application Ser. No. 12/033,035, filed on Feb. 19, 2008 now U.S. Pat. No. 7,505,563, which is a continuation of U.S. patent application Ser. No. 10/554,569, filed on Oct. 25, 2005 now U.S. Pat. No. 7,349,525, which is a national stage application of PCT/GB2004/001732, filed on Apr. 23, 2004 and which, in turn, relies on Great Britain Patent Application Number 0309374.7, filed on Apr. 25, 2003, for priority.

The present invention also relies on Great Britain Patent Application Number 0812864.7, filed on Jul. 15, 2008, for priority.

All of the aforementioned applications are incorporated herein by reference.

FIELD OF THE INVENTION

The present invention relates generally to the field of X-ray sources and more specifically to the design of anodes for X-ray sources along with cooling of the anodes of X-ray tubes.

BACKGROUND OF THE INVENTION

Multifocus X-ray sources generally comprise a single anode, typically in a linear or arcuate geometry, that may be irradiated at discrete points along its length by high energy electron beams from a multi-element electron source. Such multifocus X-ray sources can be used in tomographic imaging systems or projection X-ray imaging systems where it is necessary to move the X-ray beam.

When electrons strike the anode they lose some, or all, of their kinetic energy, the majority of which is released as heat. This heat can reduce the target lifetime and it is therefore common to cool the anode. Conventional methods include air cooling, wherein the anode is typically operated at ground potential with heat conduction to ambient through an air cooled heatsink, and a rotating anode, wherein the irradiated point is able to cool as it rotates around before being irradiated once more.

However, there is need for improved anode designs for X-ray tubes that are easy to fabricate while providing enhanced functionality, such as collimation by the anode. There is also need for improved systems for cooling anodes.

SUMMARY OF THE INVENTION

It is an object of the present invention to provide an anode for an X-ray tube comprising a target arranged to produce X-rays when electrons are incident upon it, the anode defining an X-ray aperture through which the X-rays from the target are arranged to pass thereby to be at least partially collimated by the anode.

Accordingly, the anode may be formed in two parts, and the X-ray aperture can conveniently be defined between the two parts. This enables simple manufacture of the anode. The two parts are preferably arranged to be held at a common electrical potential.

In one embodiment a plurality of target regions are defined whereby X-rays can be produced independently from each of the target regions by causing electrons to be incident upon it. This makes the anode suitable for use, for example, in X-ray tomography scanning. In this case the X-ray aperture may be one of a plurality of X-ray apertures, each arranged so that X-rays from a respective one of the target regions can pass through it.

In one embodiment the anode further defines an electron aperture through which electrons can pass to reach the target. Indeed the present invention further provides an anode for an X-ray tube comprising a target arranged to produce X-rays when electrons are incident upon it, the anode defining an electron aperture through which electrons can pass to reach the target.

In one embodiment the parts of the anode defining the electron aperture are arranged to be at substantially equal electrical potential. This can result in zero electric field within the electron aperture so that electrons are not deflected by transverse forces as they pass through the electron aperture. In one embodiment the anode is shaped such that there is substantially zero electric field component perpendicular to the direction of travel of the electrons as they approach the anode. In some embodiments the anode has a surface which faces in the direction of incoming electrons and in which the electron aperture is formed, and said surface is arranged to be perpendicular to the said direction.

In one embodiment the electron aperture has sides which are arranged to be substantially parallel to the direction of travel of electrons approaching the anode. In one embodiment the electron aperture defines an electron beam direction in which an electron beam can travel to reach the target, and the target has a target surface arranged to be impacted by electrons in the beam, and the electron beam direction is at an angle of 10° or less, more preferably 5° or less, to the target surface.

It is also an object of the present invention to provide an anode for an X-ray tube comprising at least one thermally conductive anode segment in contact with a rigid backbone and cooling means arranged to cool the anode.

In one embodiment the anode claim further comprises cooling means arranged to cool the anode. For example the cooling means may comprise a coolant conduit arranged to carry coolant through the anode. In one embodiment, the anode comprises a plurality of anode segments aligned end to end. This enables an anode to be built of a greater length than would easily be achieved using a single piece anode. Preferably the anode comprises two parts and the coolant conduit is provided in a channel defined between the two parts.

Each anode segment may be coated with a thin film. The thin film may coat at least an exposed surface of the anode segment and may comprise a target metal. For example, the film may be a film of any one of tungsten, molybdenum, uranium and silver. Application of the metal film onto the surface of the anode may be by any one of sputter coating, electro deposition and chemical deposition. Alternatively, a thin metal foil may be brazed onto the anode segment. The thin film may have a thickness of between 30 microns and 1000 microns, preferably between 50 microns and 500 microns.

In one embodiment, the anode segments are formed from a material with a high thermal conductivity such as copper. The rigid backbone may preferably be formed from stainless steel. The excellent thermal matching of copper and stainless steel means that large anode segments may be fabricated with little distortion under thermal cycling and with good mechanical stability.

The plurality of anode segments may be bolted onto the rigid backbone. Alternatively, the rigid backbone may be crimped into the anode segments using a mechanical press. Crimping reduces the number of mechanical processes required and removes the need for bolts, which introduce the risk of gas being trapped at the base of the bolts.

The integral cooling channel may extend along the length of the backbone and may either be cut into the anode segments or into the backbone. Alternatively, the channel may be formed from aligned grooves cut into both the anode segments and the backbone. A cooling tube may extend along the cooling channel and may contain cooling fluid. Preferably, the tube is an annealed copper tube. The cooling channel may have a square or rectangular cross section or, alternatively, may have a semi-circular or substantially circular cross section. A rounded cooling channel allows better contact between the cooling tube and the anode and therefore provides more efficient cooling.

The cooling fluid may be passed into the anode through an insulated pipe section. The insulated pipe section may comprise two ceramic tubes with brazed end caps, connected at one end to a stainless steel plate. This stainless steel plate may then be mounted into the X-ray tube vacuum housing. The ceramic tubes may be connected to the cooling channel by two right-angle pipe joints and may be embedded within the anode.

The present invention further provides an X-ray tube including an anode according to the invention.

The present invention is also directed to an anode for an X-ray tube comprising an electron aperture through which electrons emitted from an electron source travel subject to substantially no electrical field and a target in a non-parallel relationship to said electron aperture and arranged to produce X-rays when electrons are incident upon a first side of said target, wherein said target further comprises a cooling channel located on a second side of said target. The cooling channel comprises a conduit having coolant contained therein. The coolant is at least one of water, oil, or refrigerant.

The target comprises more than one target segment, wherein each of said target segments is in a non-parallel relationship to said electron aperture and arranged to produce X-rays when electrons are incident upon a first side of said target segment, wherein each of said target segments further comprises a cooling channel located on a second side of said target segment. The second sides of each of said target segments are attached to a backbone. The backbone is a rigid, single piece of metal, such as stainless steel. At least one of said target segments is connected to said backbone using a bolt. At least one of said target segments is connected to said backbone by placing said backbone within crimped protrusions formed on the second side of said target segment. Each of the target segments is held at a high voltage positive electrical potential with respect to said electron source. The first side of each of the target segments is coated with a target metal, wherein said target metal is at least one of molybdenum, tungsten, silver, metal foil, or uranium. The backbone is made of stainless steel and said target segments are made of copper. The conduit is electrically insulated and the cooling channel has at least one of a square, rectangular, semi-circular, or flattened semi-circular cross-section.

In another embodiment, the present invention is directed toward an X-ray tube comprising an anode further comprising at least one electron aperture through which electrons emitted from an electron source travel subject to substantially no electrical field, a target in a non-parallel relationship to said electron aperture and arranged to produce X-rays when electrons are incident upon a first side of said target, wherein said target further comprises a cooling channel located on a second side of said target, and at least one of aperture comprising an X-ray aperture through which the X-rays from the target pass through, and are at least partially collimated by, the X-ray aperture. The cooling channel comprises a conduit having coolant contained therein, such as water, oil, or refrigerant.

The target comprises more than one target segment, wherein each of said target segments is in a non-parallel relationship to said electron aperture and arranged to produce X-rays when electrons are incident upon a first side of said target segment, wherein each of said target segments further comprises a cooling channel located on a second side of said target segment. The second sides of each of said target segments are attached to a backbone. At least one of said target segments is connected to said backbone by a) a bolt or b) placing said backbone within crimped protrusions formed on the second side of said target segment. Each of the target segments is held at a high voltage positive electrical potential with respect to said electron source.

BRIEF DESCRIPTION OF THE DRAWINGS

These and other features and advantages of the present invention will be appreciated as they become better understood by reference to the following Detailed Description when considered in connection with the accompanying drawings, wherein.

DETAILED DESCRIPTION OF THE INVENTION

Figure 1:
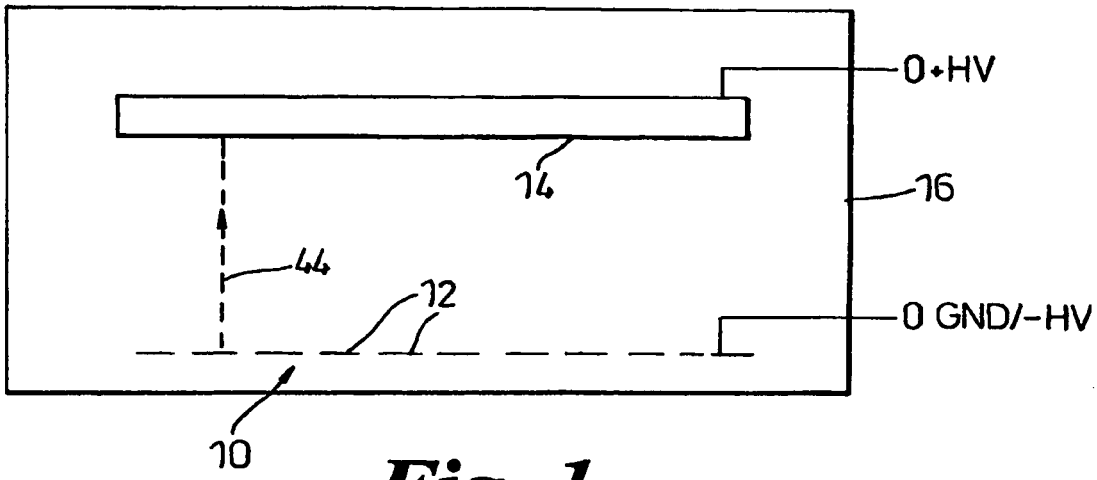
FIG. 1 is a schematic representation of an X-ray tube according to a first embodiment of the invention.

Referring to FIG. 1, an X-ray tube according to the invention comprises a multi-element electron source 10 comprising a number of elements 12 each arranged to produce a respective beam of electrons, and a linear anode 14, both enclosed in a tube envelope 16. The electron source elements 12 are held at a high voltage negative electrical potential with respect to the anode.

Figure 2:
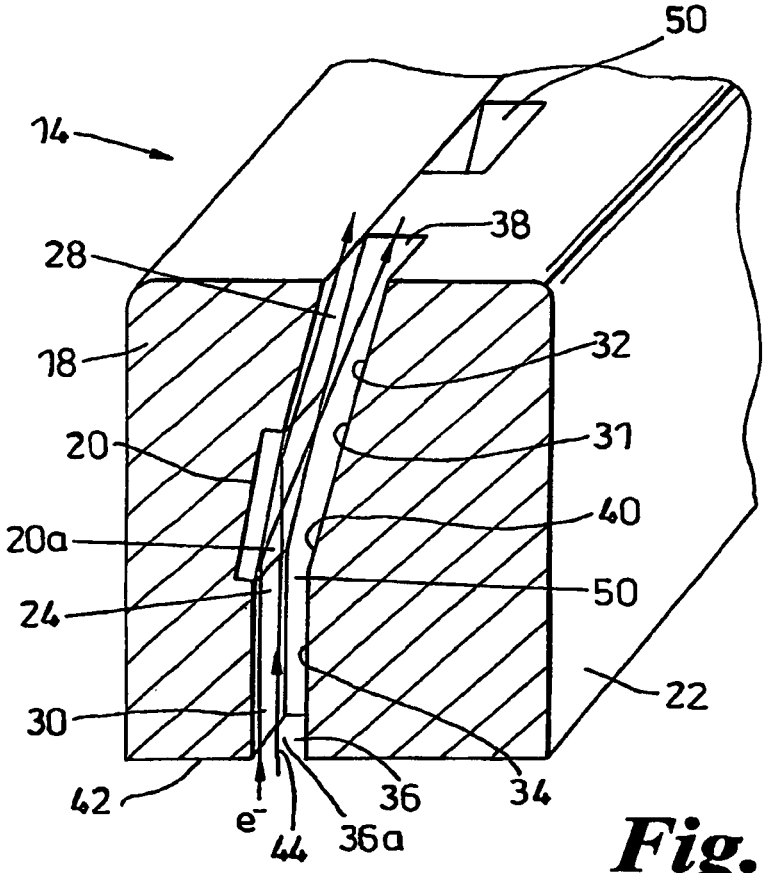
FIG. 2 is a partial perspective view of an anode according to a second embodiment of the invention.

Referring to FIG. 2, the anode 14 is formed in two parts: a main part 18 which has a target region 20 formed on it, and a collimating part 22, both of which are held at the same positive potential, being electrically connected together. The main part 18 comprises an elongate block having an inner side 24 which is generally concave and made up of the target region 20, an X-ray collimating surface 28, and an electron aperture surface 30. The collimating part 22 extends parallel to the main part 18. The collimating part 22 of the anode is shaped so that its inner side 31 fits against the inner side 24 of the main part 18, and has a series of parallel channels 50 formed in it such that, when the two parts 18, 22 of the anode are placed in contact with each other, they define respective electron apertures 36 and X-ray apertures 38. Each electron aperture 36 extends from the surface 42 of the anode 14 facing the electron source to the target 20, and each X-ray aperture extends from the target 20 to the surface 43 of the anode 14 facing in the direction in which the X-ray beams are to be directed. A region 20*a* of the target surface 20 is exposed to electrons entering the anode 14 through each of the electron apertures 36, and those regions 20*a* are treated to form a number of discrete targets.

In this embodiment, the provision of a number of separate apertures through the anode 14, each of which can be aligned with a respective electron source element, allows good control of the X-ray beam produced from each of the target regions 20*a*. This is because the anode can provide collimation of the X-ray beam in two perpendicular directions. The target region 20 is aligned with the electron aperture 36 so that electrons passing along the electron aperture 36 will impact the target region 20. The two X-ray collimating surfaces 28, 32 are angled slightly to each other so that they define between them an X-ray aperture 38 which widens slightly in the direction of travel of the X-rays away from the target region 20. The target region 20, which lies between the electron aperture surface 30 and the X-ray collimating surface 28 on the main anode part 18 is therefore opposite the region 40 of the collimating part 22 where its electron aperture surface 34 and X-ray collimating surface 32 meet.

Adjacent the outer end 36*a* of the electron aperture 36, the surface 42 of the anode 14 which faces the incoming electrons and is made up on one side of the electron aperture 36 by the main part 18 and on the other side by the collimating part 22, is substantially flat and perpendicular to the electron aperture surfaces 30, 34 and the direction of travel of the incoming electrons. This means that the electrical field in the path of the electrons between the source elements 12 and the target 20 is parallel to the direction of travel of the electrons between the source elements 12 and the surface 42 of the anode facing the source elements 12. Then within the electron aperture 36 between the two parts 18, 22 of the anode 14 there is substantially no electric field, the electric potential in that space being substantially constant and equal to the anode potential.

In use, each of the source elements 12 is activated in turn to project a beam 44 of electrons at a respective area of the target region 20. The use of successive source elements 12 and successive areas of the target region enables the position of the X-ray source to be scanned along the anode 14 in the longitudinal direction perpendicular to the direction of the incoming electron beams and the X-ray beams. As the electrons move in the region between the source 12 and the anode 14 they are accelerated in a straight line by the electric field which is substantially straight and parallel to the required direction of travel of the electrons. Then, when the electrons enter the electron aperture 36 they enter the region of zero electric field which includes the whole of the path of the electrons inside the anode 14 up to their point if impact with the target 20. Therefore throughout the length of their path there is substantially no time at which they are subject to an electric field with a component perpendicular to their direction of travel. The only exception to this is any fields which are provided to focus the electron beam. The advantage of this is that the path of the electrons as they approach the target 20 is substantially straight, and is unaffected by, for example, the potentials of the anode 14 and source 12, and the angle of the target 20 to the electron trajectory.

When the electron beam 44 hits the target 20 some of the electrons produce fluorescent radiation at X-ray energies. This X-ray radiation is radiated from the target 20 over a broad range of angles. However the anode 14, being made of a metallic material, provides a high attenuation of X-rays, so that only those leaving the target in the direction of the collimating aperture 38 avoid being absorbed within the anode 14. The anode therefore produces a collimated beam of X-rays, the shape of which is defined by the shape of the collimating aperture 38. Further collimation of the X-ray beam may also be provided, in conventional manner, externally of the anode 14.

Some of the electrons in the beam 44 are backscattered from the target 20. Backscattered electrons normally travel to the tube envelope where they can create localised heating of the tube envelope or build up surface charge that can lead to tube discharge. Both of these effects can lead to reduction in lifetime of the tube. In this embodiment, electrons backscattered from the target 20 are likely to interact with the collimating part 22 of the anode 14, or possibly the main part 18. In this case, the energetic electrons are absorbed back into the anode 14 so avoiding excess heating, or surface charging, of the tube envelope 16. These backscattered electrons typically have a lower energy than the incident (full energy) electrons and are therefore more likely to result in lower energy bremsstrahlung radiation than fluorescence radiation. There is a high chance that this extra off-focal radiation will be absorbed within the anode 14 and therefore there is little impact of off-focal radiation from this anode design.

In this particular embodiment shown in FIG. 2, the target 20 is at a low angle of preferably less than 10°, and in this case about 5°, to the direction of the incoming electron beam 44, so that the electrons hit the target 20 at a glancing angle. The X-ray aperture 38 is therefore also at a low angle, in this case about 10° to the electron aperture 36. With conventional anodes, it is particularly in this type of target geometry that the incoming electrons tend to be deflected by the electric field from the target before hitting it, due to the high component of the electric field in the direction transverse to the direction of travel of the electrons. This makes glancing angle incidence of the electrons on the anode very difficult to achieve. However, in this embodiment the regions inside the electron aperture 36 and the X-ray aperture 38 are at substantially constant potential and therefore have substantially zero electric field. Therefore the electrons travel in a straight line until they impact on the target 20. This simplifies the design of the anode, and makes the glancing angle impact of the electrons on the anode 20 a practical design option. One of the advantages of the glancing angle geometry is that a relatively large area of the target 20, much wider than the incident electron beam, is used. This spreads the heat load in the target 20 which can improve the efficiency and lifetime of the target.

Figure 3:
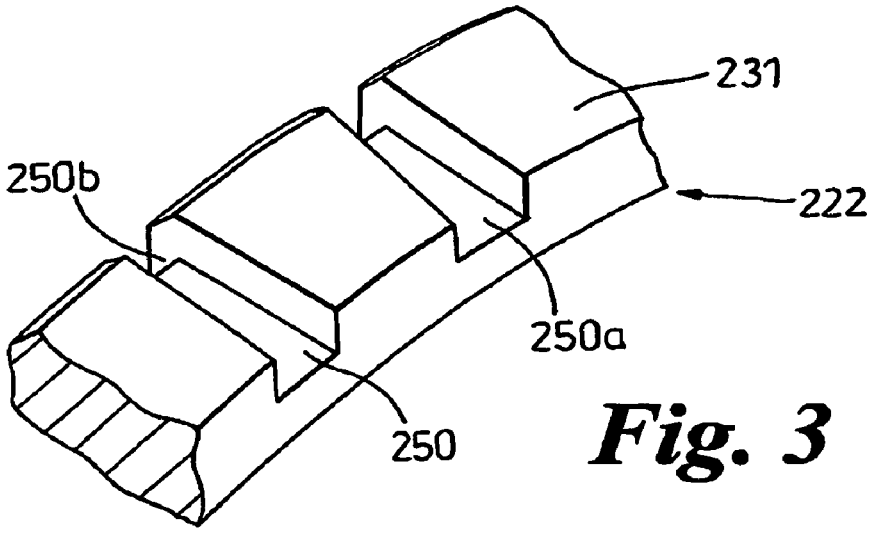
FIG. 3 is a partial perspective view of a part of an anode according to a third embodiment of the invention.
Figure 4:
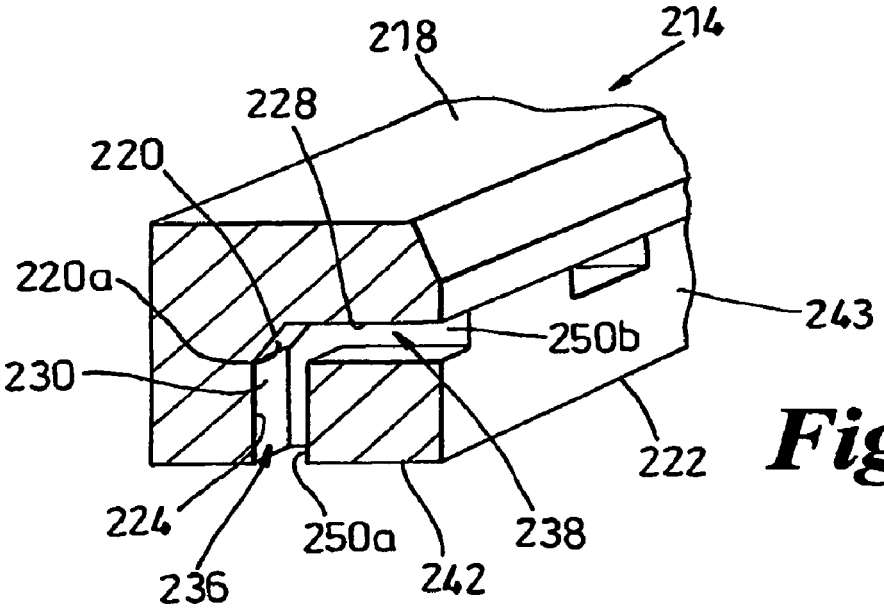
FIG. 4 is a partial perspective view of the anode of FIG. 4.

Referring to FIGS. 3 and 4, the anode of a second embodiment of the invention is similar to the first embodiment, and corresponding parts are indicated by the same reference numeral increased by 200. In this second embodiment, the main part 218 of the anode is shaped in a similar manner to that of the first embodiment, having an inner side 224 made up of a target surface 220, and an X-ray collimating surface 228 and an electron aperture surface 230, in this case angled at about 11° to the collimating surface 228. The collimating part 222 of the anode again has a series of parallel channels 250 formed in it, each including an electron aperture part 250*a*, and an X-ray collimating part 250*b* such that, when the two parts 218, 222 of the anode are placed in contact with each other, they define respective electron apertures 236 and X-ray apertures 238. The two X-ray collimating surfaces 228, 232 are angled at about 90° to the electron aperture surfaces 230, 234 but are angled slightly to each other so that they define between them the X-ray aperture 238 which is at about 90° to the electron aperture 236.

As with the embodiment of FIG. 2, the embodiment of FIGS. 3 and 4 shows that the collimating apertures 238 broaden out in the horizontal direction, but are of substantially constant height. This produces a fan-shaped beam of X-rays suitable for use in tomographic imaging. However it will be appreciated that the beams could be made substantially parallel, or spreading out in both horizontal and vertical directions, depending on the needs of the particular application.

Figure 5:
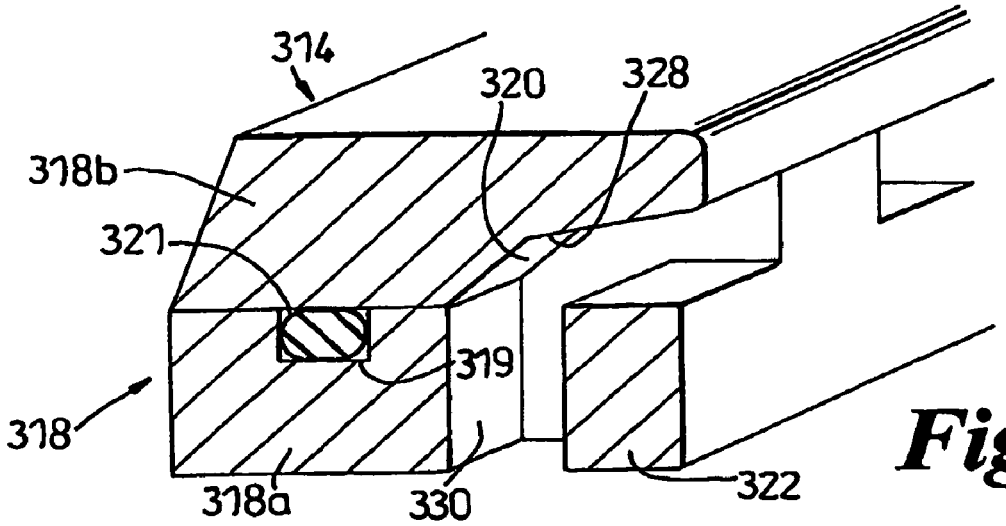
FIG. 5 is a partial perspective view of an anode according to a fourth embodiment of the invention.

Referring to FIG. 5, in a third embodiment of the invention the anode includes a main part 318 and a collimating part 322 similar in overall shape to those of the first embodiment. Other parts corresponding to those in FIG. 2 are indicated by the same reference numeral increased by 300. In this embodiment the main part 318 is split into two sections 318*a*, 318*b*, one 318*a* which includes the electron aperture surface 330, and the other of which includes the target region 320 and the X-ray collimating surface 328. One of the sections 318*a* has a channel 319 formed along it parallel to the target region 320, i.e. perpendicular to the direction of the incident electron beam and the direction of the X-ray beam. This channel 319 is closed by the other of the sections 318*b* and has a coolant conduit in the form of a ductile annealed copper pipe 321 inside it which is shaped so as to be in close thermal contact with the two sections 318*a*, 318*b* of the anode main part 318. The pipe 321 forms part of a coolant circuit such that it can have a coolant fluid, such as a transformer oil or fluorocarbon, circulated through it to cool the anode 314. It will be appreciated that similar cooling could be provided in the collimating part 322 of the anode if required.

Figures 6A, 6B:
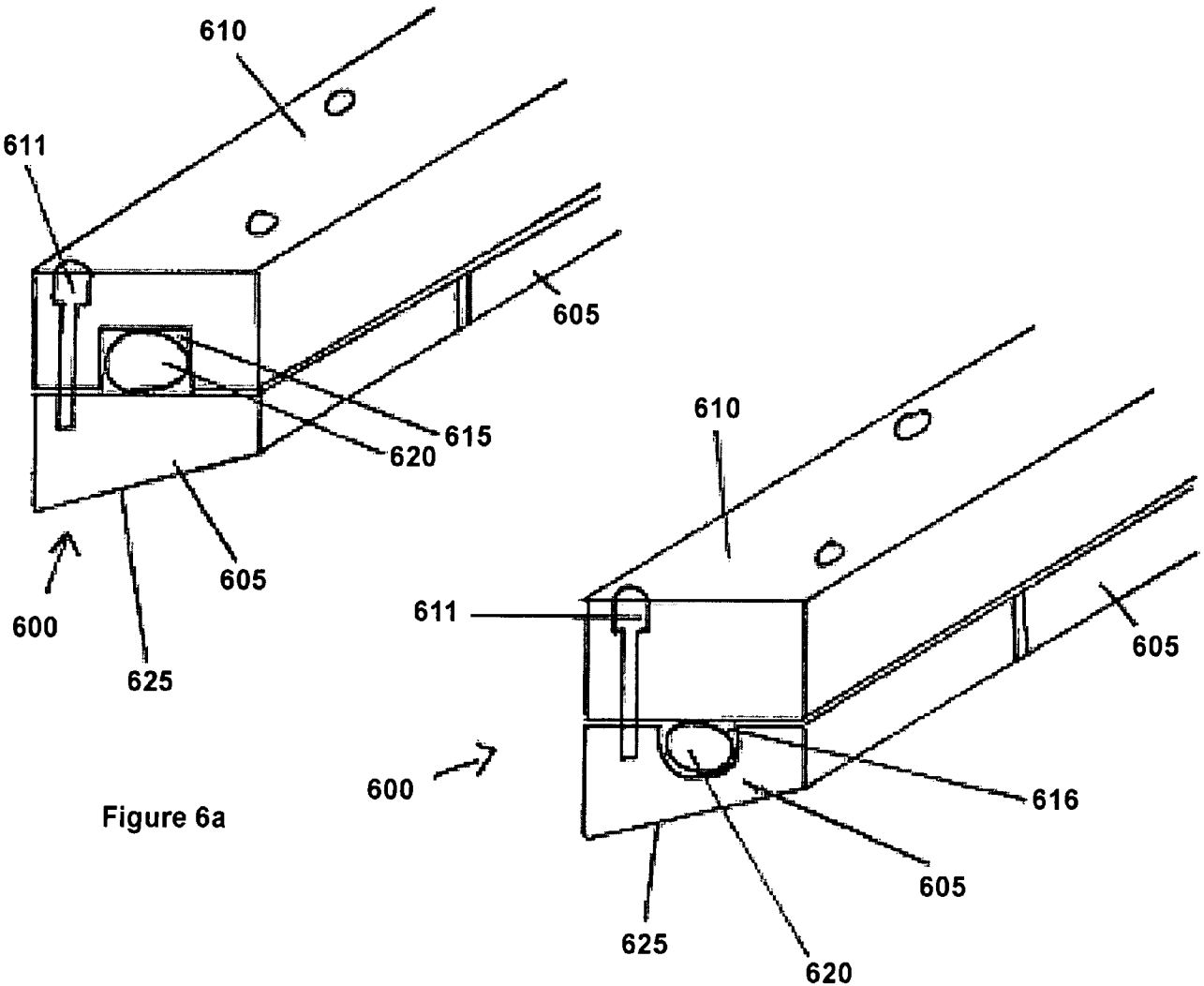
FIG. 6*a* is a cross section through an anode according to an embodiment of the invention.
FIG. 6*b* shows an alternative embodiment of the anode of FIG. 6*a;*

Referring to FIGS. 6*a* and 6*b*, an anode 600 according to one embodiment of the present invention comprises a plurality of thermally conductive anode segments 605 bolted to a rigid single piece backbone 610 by bolts 611. A cooling channel 615, 616 extends along the length of the anode between the anode segments and the backbone and contains a coolant conduit in the form of a tube 620 arranged to carry the cooling fluid.

The anode segments 605 are formed from a metal such as copper and are held at a high voltage positive electrical potential with respect to an electron source. Each anode segment 605 has an angled front face 625, which is coated with a suitable target metal such as molybdenum, tungsten, silver or uranium selected to produce the required X-rays when electrons are incident upon it. This layer of target metal is applied to the front surface 625 using one of a number of methods including sputter coating, electrodeposition and chemical vapour deposition. Alternatively, a thin metal foil with a thickness of 50-500 microns is brazed onto the copper anode surface 625.

Referring to FIG. 6*a*, the cooling channel 615 is formed in the front face of the rigid backbone 610 and extends along the length of the anode. In one embodiment the cooling channel 615 has a square or rectangular cross-section and contains an annealed copper coolant tube 620, which is in contact with both the copper anode segments 605, the flat rear face of which forms the front side of the channel, and the backbone 610. A cooling fluid such as oil is pumped through the coolant tube 620 to remove heat from the anode 600. FIG. 6*b* shows an alternative embodiment in which the coolant channel 616 is cut into the anode segments 605. In one embodiment the cooling channel 616 has a semi-circular cross section with a flat rear surface of the channel being provided by the backbone 610. The semi-circular cross section provides better contact between the coolant tube 620 and the anode segments 605, thereby improving the efficiency of heat removal from the anode 600. Alternatively, the cooling channel may comprise two semi-circular recesses in both the backbone 610 and the anode segments 605, forming a cooling channel with a substantially circular cross-section.

In one embodiment the rigid single piece backbone 610 is formed from stainless steel and can be made using mechanically accurate and inexpensive processes such as laser cutting while the smaller copper anode segments 605 are typically fabricated using automated machining processes. The backbone 610 is formed with a flat front face and the anode segments 605 are formed with flat rear faces to ensure good thermal contact between them when these flat faces are in contact. Due to the excellent thermal matching of copper and stainless steel and the good vacuum properties of both materials, large anode segments may be fabricated with little distortion under thermal cycling and with good mechanical stability.

The bolts 611 fixing the anode segments 605 onto the backbone 610 pass through bores that extend from a rear face of the backbone, through the backbone 610 to its front face, and into threaded blind bores in the anode segments 605. During assembly of the anode 600, there is potential for gas pockets to be trapped around the base of these bolts 611. Small holes or slots may therefore be cut into the backbone or anode to connect these holes to the outer surface of the backbone or anode, allowing escape of the trapped pockets of gas.

In accordance with an aspect of the present invention, bolting a number of anode segments 605 onto a single backbone 610, as shown in FIGS. 6*a* and 6*b*, enables an anode to be built that extends for several meters. This would otherwise generally be expensive and complicated to achieve.

Figure 7:
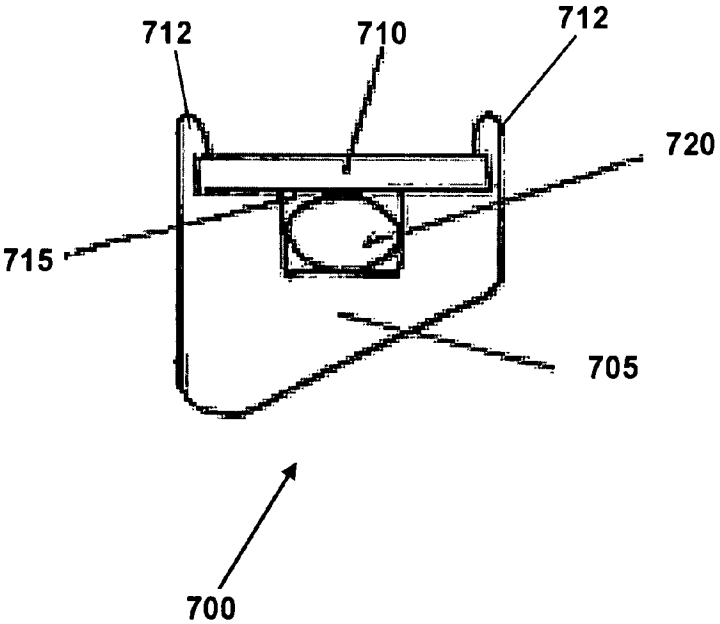
FIG. 7 shows an anode segment crimped to a backbone.

FIG. 7 shows an alternative design in which a single piece rigid backbone 710 in the form of a flat plate is crimped into the anode segments 705 using a mechanical press. Crimping causes holding members 712 to form in the back of the anode segments, thereby defining a space for holding the backbone 710. In one embodiment, a square cut cooling channel 715 is cut into the back surface of the anode segments 705 and extends along the length of the anode, being covered by the backbone 710. Coolant fluid is passed through an annealed copper coolant tube 720, which sits inside the cooling channel 715, to remove heat generated in the anode 700. This design reduces the machining processes required in the anode and also removes the need for bolts and the associated potential of trapped gas volumes at the base of the bolts.

Figure 8:
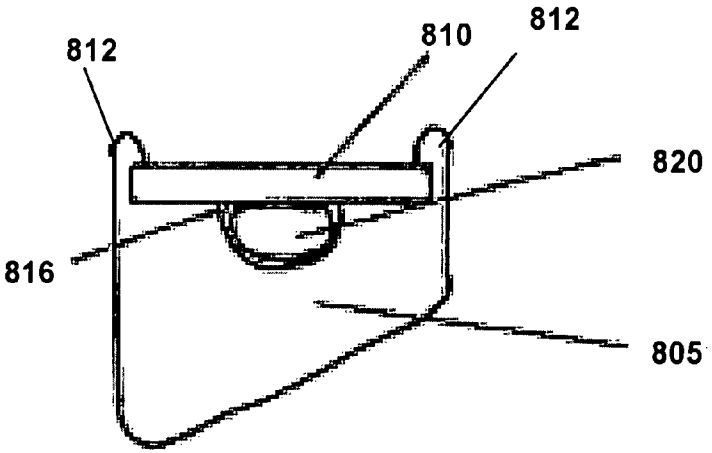
FIG. 8 shows the anode of FIG. 7 with a round-ended cooling channel.

FIG. 8 shows a similar design of anode to that shown in FIG. 7, wherein a rigid backbone 810 is crimped into anode segments 805. Crimping causes holding members 812 to form in the back of the anode segments, thereby defining a space for holding the backbone 810. In this embodiment, a cooling channel 816 of curved cross-section, in this case semi-elliptical, extends along the length of the anode and is cut into the anode segments 805 with a round-ended tool. A coolant tube 820 sits inside the cooling channel 816 and is filled with a cooling fluid such as oil, water or refrigerant. The rounded cooling channel 816 provides superior contact between the coolant tube 820, which is of a rounded shape to fit in the channel 816, and the anode segments 805.

Figure 9:
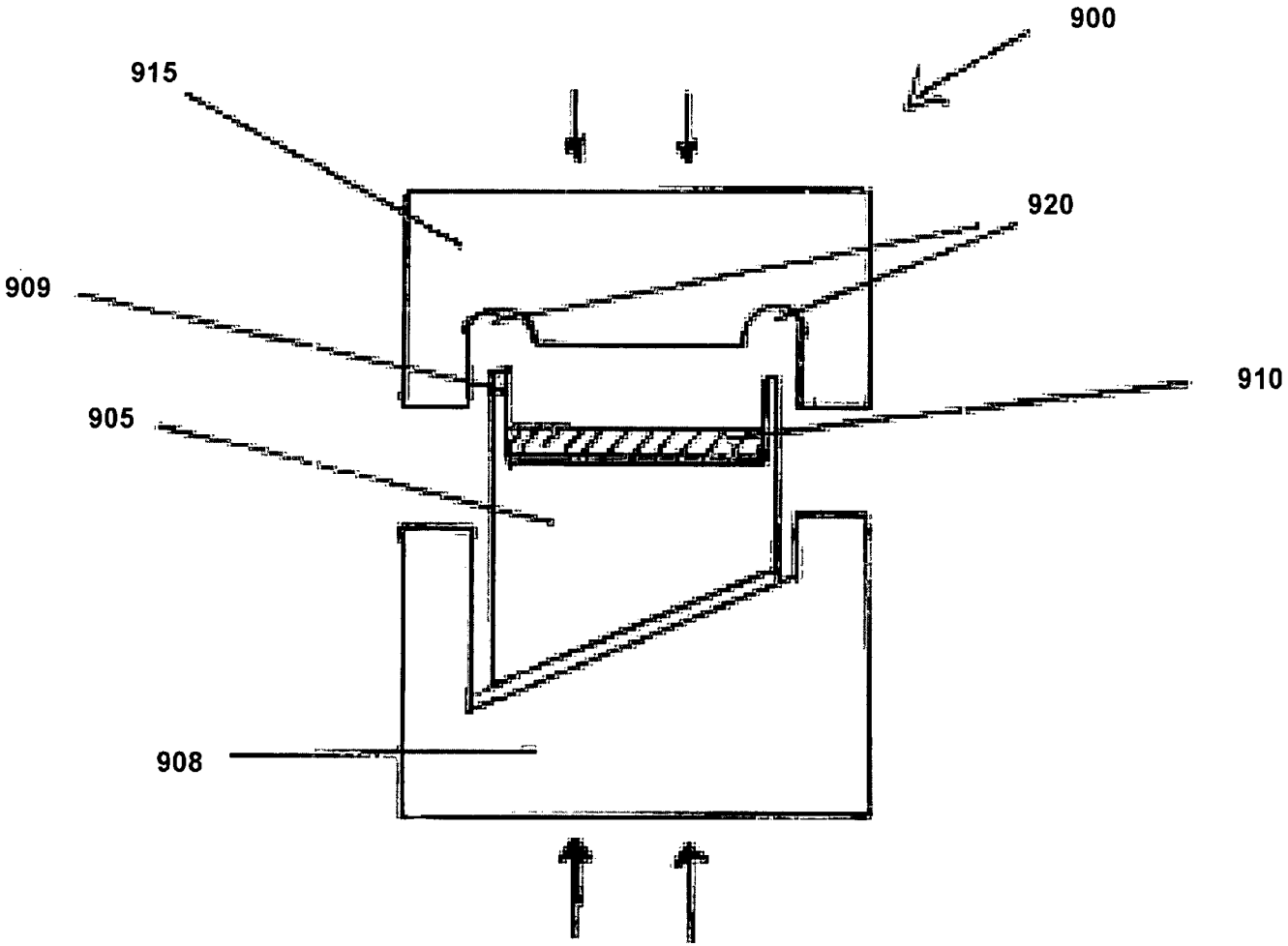
FIG. 9 shows the crimping tool used to crimp an anode segment to a backbone.

Referring now to FIG. 9, the anode of FIGS. 7 and 8 is formed using a crimp tool 900. The coated copper anode segments 905 are supported in a base support 908 with walls 909 projecting upwards from the sides of the rear face of the anode segments 905. The rigid backbone 910 is placed onto the anode segments 905, fitting between the projecting anode walls 909. An upper part 915 of the crimp tool 900 has grooves 920 of a rounded cross section formed in it arranged to bend over and deform the straight copper walls 909 of the anode segments 905 against the rear face of the backbone as it is lowered towards the base support 908, crimping the backbone 910 onto the anode segments 905. Typically a force of 0.3-0.7 tonne/cm length of anode segment is required to complete the crimping process. As a result of the crimping process the crimped edges of the anode segments form a continuous rounded ridge along each side of the backbone. It will be appreciated that other crimping arrangements could be used, for example the anode segments could be crimped into grooves in the sides of the backbone, or the backbone could be crimped into engagement with the anode.

In use, the anode segments 905 are held at a relatively high electrical potential. Any sharp points on the anode can therefore lead to a localised high build up of electrostatic charge and result in electrostatic discharge. Crimping the straight copper walls 909 of the anode segments 905 around the backbone 910 provides the anode segments with rounded edges and avoids the need for fasteners such as bolts. This helps to ensure an even distribution of charge over the anode and reduces the likelihood of electrostatic discharge from the anode.

To pass the coolant fluid into the anode it is often necessary to use an electrically insulated pipe section since the anode is often operated at positive high voltage with respect to ground potential. Non-conducting, in this case ceramic, tube sections may be used to provide an electrically isolated connection between coolant tubes and an external supply of coolant fluid. The coolant fluid is pumped through the ceramic tubes into the coolant tube, removing the heat generated as X-rays are produced.

Figure 10:
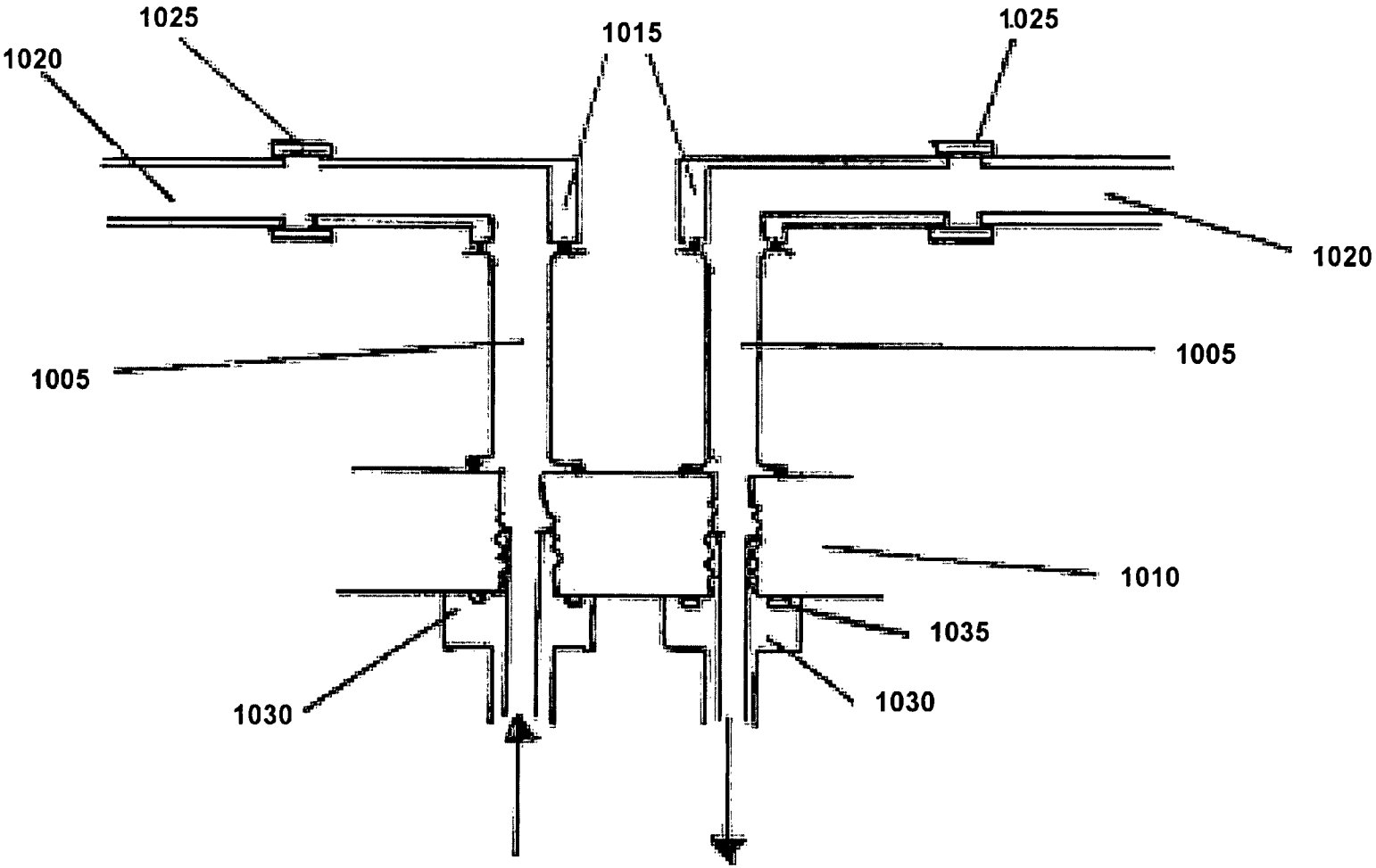
FIG. 10 shows an insulated pipe section for connection to a coolant tube in a coolant channel.

FIG. 10 shows an insulated pipe section comprising two ceramic breaks 1005 (ceramic tubes with brazed end caps) welded at a first end to a stainless steel plate 1010. This stainless steel plate 1010 is then mounted into the X-ray tube vacuum housing. Two right-angle sections 1015 are welded at one end to a second end of the ceramic breaks 1005. The other ends of the right-angle sections 1015 are then brazed to the coolant tube 1020, which extends along the cooling channels 615, 616 of the anode 600 of FIGS. 6*a* and 6*b* respectively. A localised heating method is used, such as induction brazing using a copper collar 1025 around the coolant tube 1020 and right angle parts 1015. Threaded connectors 1030 on the external side of the stainless steel plate 1010 attach the insulated pipe section to external coolant circuits. These connectors 1030 may be welded to the assembly or screwed in using O-ring seals 1035, for example.

In order to maximise the electrostatic performance of the anode 600 of FIGS. 6*a* and 6*b*, it is advantageous to embed the high voltage right-angle sections of the coolant assembly, such as those shown in FIG. 10, within the anode itself. Following connection of the insulated pipe section to the coolant tube 720, 820 it may not be possible to crimp the backbone 710, 810 in the anode segments 705, 805, as shown in FIGS. 7 and 8 respectively. In this case, a mechanical fixing such as the bolts 611 shown in FIGS. 6*a* and 6*b* are used.

Figure 11:
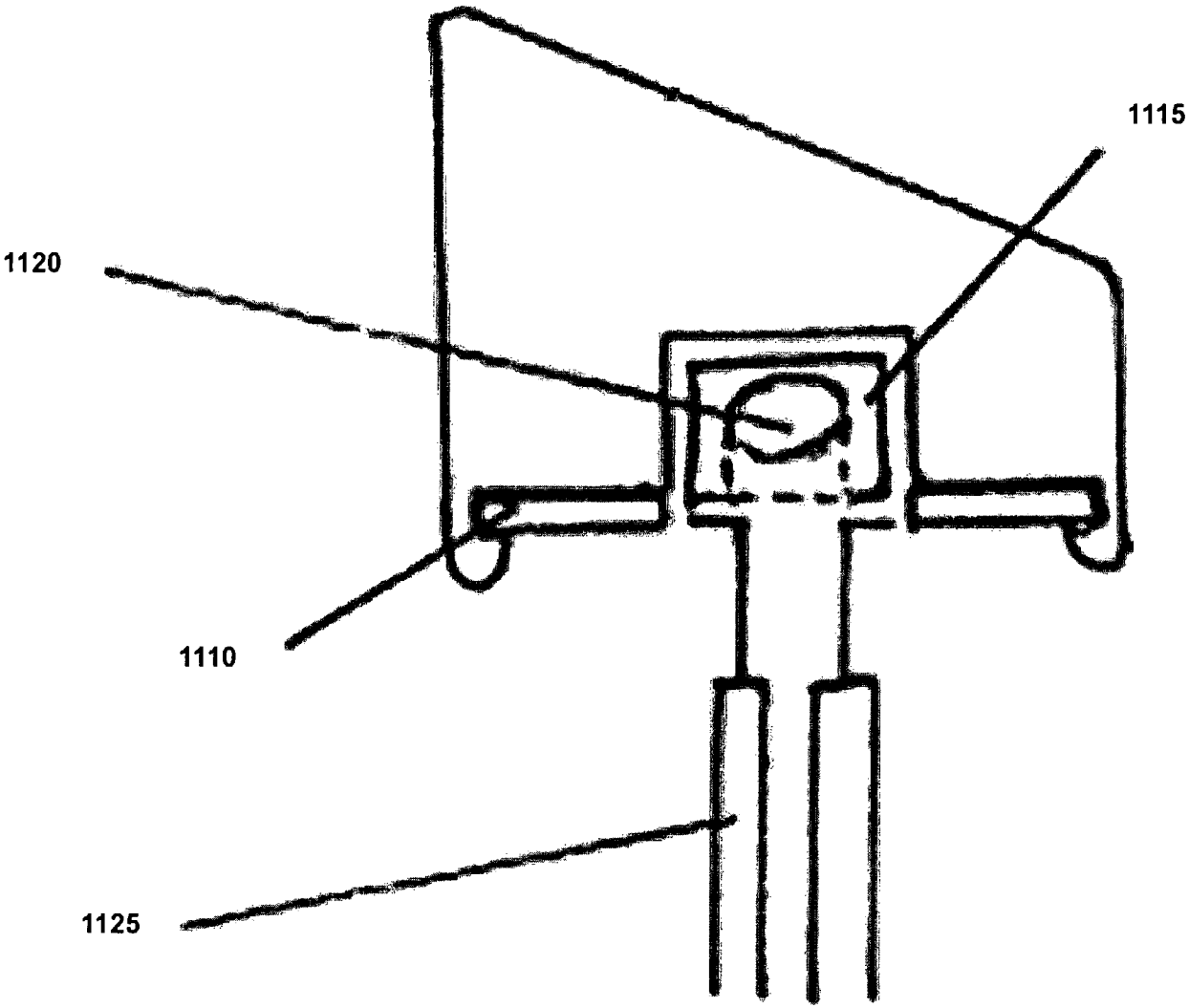
FIG. 11 shows the insulated pipe section of FIG. 10 connected to a coolant tube.

Alternatively, the pipe section can be connected to a crimped anode such as those shown in FIGS. 7 and 7 from outside of the anode. Referring to FIG. 11, a gap is cut into the rigid backbone 1110. The right angle sections 1115 extend through the gap in the backbone 1110 and are brazed at one end onto the coolant tube 1120. On the external side of the rigid backbone 1110 the right angle sections are welded onto ceramic breaks 1125, which are connected to external cooling circuits.

We claim:

1. An anode for an X-ray tube comprising a. an electron aperture for receiving electrons emitted from an electron source travel;

b. a target in a non-parallel relationship to said electron aperture and arranged to produce X-rays when electrons are incident upon a first side of said target, wherein said target further comprises a cooling channel located on a second side of said target; and c. a channel extending from said electron aperture to said target wherein electrons passing through said channel are subjected to substantially no electrical field.

2. The anode of claim 1 wherein the cooling channel comprises a conduit having coolant contained therein.

3. The anode of claim 2 wherein the coolant is at least one of water, oil, or refrigerant.

4. The anode of claim 1 wherein said target comprises more than one target segment, wherein each of said target segments is in a non-parallel relationship to said electron aperture and arranged to produce X-rays when electrons are incident upon a first side of said target segment, wherein each of said target segments further comprises a cooling channel located on a second side of said target segment.

5. The anode of claim 4 wherein said second sides of each of said target segments are attached to a backbone.

6. The anode of claim 5 wherein the backbone is a rigid, single piece of metal.

7. The anode of claim 6 wherein the backbone comprises stainless steel.

8. The anode of claim 7 wherein at least one of said target segments is connected to said backbone using a bolt.

9. The anode of claim 8 wherein at least one of said target segments is connected to said backbone by placing said backbone within crimped protrusions formed on the second side of said target segment.

10. The anode of claim 4 wherein each of the target segments is held at a high voltage positive electrical potential with respect to said electron source.

11. The anode of claim 4 wherein the first side of each of the target segments is coated with a target metal, wherein said target metal is at least one of molybdenum, tungsten, silver, metal foil, or uranium.

12. The anode of claim 5 wherein the backbone is made of stainless steel and said target segments are made of copper.

13. The anode of claim 2 wherein the conduit is electrically insulated and the cooling channel has at least one of a square, rectangular, semi-circular, or flattened semi-circular cross-section.

14. An X-ray tube comprising:

an anode further comprising at least one electron aperture for receiving electrons emitted from an electron source, a target in a non-parallel relationship to said electron aperture and arranged to produce X-rays when electrons are incident upon a first side of said target, wherein said target further comprises a cooling channel located on a second side of said target, a channel extending from said electron aperture to said target wherein electrons passing through said channel are subjected to substantially no electrical field, and at least one of aperture comprising an X-ray aperture through which the X-rays from the target pass through, and are at least partially collimated by, the X-ray aperture.

15. The anode of claim 14 wherein the cooling channel comprises a conduit having coolant contained therein.

16. The anode of claim 15 wherein the coolant is at least one of water, oil, or refrigerant.

17. The anode of claim 14 wherein said target comprises more than one target segment, wherein each of said target segments is in a non-parallel relationship to said electron aperture and arranged to produce X-rays when electrons are incident upon a first side of said target segment, wherein each of said target segments further comprises a cooling channel located on a second side of said target segment.

18. The anode of claim 17 wherein said second sides of each of said target segments are attached to a backbone.

19. The anode of claim 18 wherein at least one of said target segments is connected to said backbone by a) a bolt or b) placing said backbone within crimped protrusions formed on the second side of said target segment.

20. The anode of claim 14 wherein each of the target segments is held at a high voltage positive electrical potential with respect to said electron source.

* * * * *